US011666159B2

(12) United States Patent
Arriagada Lama

(10) Patent No.: US 11,666,159 B2
(45) **Date of Patent: *Jun. 6, 2023**

(54) CONFIGURABLE AND DISMANTLABLE DISPLAY CASE SYSTEM AND METHOD OF ASSEMBLY

(71) Applicant: MBM SpA, Santiago (CL)

(72) Inventor: Christian Andres Arriagada Lama, Santiago (CL)

(73) Assignee: MBM SpA, Santiago (CL)

( * ) Notice: Subject to any disclaimer, the term of this patent is extended or adjusted under 35 U.S.C. 154(b) by 70 days.

This patent is subject to a terminal disclaimer.

(21) Appl. No.: 16/942,363

(22) Filed: Jul. 29, 2020

(65) Prior Publication Data

US 2020/0352354 A1 Nov. 12, 2020

Related U.S. Application Data

(63) Continuation-in-part of application No. 15/737,941, filed as application No. PCT/CL2016/000029 on Jun. 13, 2016, now Pat. No. 10,729,237.

(30) Foreign Application Priority Data

Jun. 24, 2015 (CL) ..... 1832-2015

(51) Int. Cl.
*A47B 47/04* (2006.01)
*A47F 3/14* (2006.01)
(Continued)

(52) U.S. Cl.
CPC ..... *A47F 3/004* (2013.01); *A47F 3/001* (2013.01); *A47F 3/06* (2013.01); *A47F 3/14* (2013.01);
(Continued)

(58) Field of Classification Search
CPC ... A47B 47/042; A47B 47/045; A47B 47/047; A47B 47/0091; A47B 7/042;
(Continued)

(56) References Cited

U.S. PATENT DOCUMENTS 3,170,415 A * 2/1965 Svilokos ..... F16B 12/12 108/53.5
3,180,288 A * 4/1965 McCowan ..... A47B 87/0246 108/53.5
(Continued)

FOREIGN PATENT DOCUMENTS

CA 2893531 A1 * 12/2015 ..... A47B 47/0091
CN 203748945 U * 8/2014 ..... A47B 81/002
(Continued)

*Primary Examiner* — Michael Safavi

(57) ABSTRACT

A configurable, dismantlable display case system, with supports for promotional graphics, for use as a display cabinet, the constitution thereof being simple and entailing a reduced cost, and with the possibility of changing the configuration of its assembly and the promotional campaign thereon. The modular display system includes generally of a plastic shelving unit, with trays at different levels, linked at their corners by means of pillars of a generally triangular shape, which fit adjustedly into corresponding housings, one at each corner and on both sides of each tray; short profiles of a more reduced length than the pillar profiles, of a generally triangular shape with rounded corners which slot adjustedly into the corresponding housings of the tray; and non-slip ferrules inserted into the profile forming the leg at the area in contact with the floor; and assembly method.

20 Claims, 12 Drawing Sheets

(51) Int. Cl.

| | |
|---|---|
| ***A47F 3/00*** | (2006.01) |
| ***A47F 3/06*** | (2006.01) |
| ***G09F 3/20*** | (2006.01) |
| ***G09F 15/00*** | (2006.01) |
| ***G09F 23/06*** | (2006.01) |

(52) U.S. Cl.
CPC ..... *G09F 3/204* (2013.01); *G09F 15/0018* (2013.01); *G09F 23/06* (2013.01)

(58) Field of Classification Search
CPC ..... A47B 47/0083; A47B 87/008; A47B 87/0207; A47B 87/0223; A47F 5/00; A47F 5/0062; A47F 3/004; A47F 3/001; A47F 3/06; A47F 3/14; A47F 5/0018; A47F 5/0025; G09F 3/04; G09F 3/06; G09F 15/0018; G09F 23/06
USPC ..... 211/194, 153, 188; 108/156, 158.12, 64, 108/91, 180, 185, 186, 192; 40/606.08; D6/675.1
See application file for complete search history.

(56) References Cited

U.S. PATENT DOCUMENTS 3,672,723 A * 6/1972 Decursu et al. ..... A47C 13/005 297/440.22
3,834,324 A * 9/1974 Lang ..... A47B 87/0246 108/190
3,874,511 A * 4/1975 Maslow ..... A47B 57/265 211/153
3,981,250 A * 9/1976 Anthony ..... A47B 57/26 108/106
4,158,336 A * 6/1979 Brescia ..... F16B 9/09 108/190
4,334,571 A * 6/1982 Heller ..... A47B 47/042 52/36.5
4,442,778 A * 4/1984 Lang ..... A47B 87/0246 211/186
4,574,709 A * 3/1986 Lackey ..... A47B 87/0223 211/186
4,593,826 A * 6/1986 Bustos ..... A47B 57/265 211/208
4,621,740 A * 11/1986 Lang ..... A47B 87/0223 211/126.12
4,638,745 A * 1/1987 Sheffer ..... A47F 5/112 108/156
4,644,876 A * 2/1987 Thomas ..... F16B 12/50 108/154
4,706,576 A * 11/1987 James ..... A47B 57/545 108/106
4,763,796 A * 8/1988 Flum ..... A47F 1/12 211/186
4,811,670 A * 3/1989 Kolvites ..... A47B 57/265 211/187
4,901,872 A * 2/1990 Lang ..... A47B 87/0223 211/188
4,940,150 A * 7/1990 Spengler ..... A47B 87/0223 211/188
D325,138 S * 4/1992 Levin ..... D6/675.1
5,125,520 A * 6/1992 Kawasaki ..... B62B 3/188 108/91
5,158,187 A * 10/1992 Taub ..... A47B 87/0223 211/186
5,270,366 A * 12/1993 Hein ..... C08K 3/32 524/145
5,271,337 A * 12/1993 Kolvites ..... A47B 57/265 108/107
D355,798 S * 2/1995 Goetz ..... D6/675.1
5,400,719 A * 3/1995 Santapa ..... A47B 87/0223 D6/675.3
D367,784 S * 3/1996 Goetz ..... D6/675.1
D386,019 S * 11/1997 Grosfillex ..... D6/675.1
5,709,158 A * 1/1998 Wareheim ..... A47B 87/0246 211/188
D406,961 S * 3/1999 Simpson, II ..... D6/678.1
D412,075 S * 7/1999 Gingrich ..... D6/675.1
6,062,150 A * 5/2000 Sikora ..... A47B 87/0223 211/186
6,079,339 A * 6/2000 Houk, Jr. ..... A47B 87/0223 211/186
6,202,867 B1 * 3/2001 Di Blasi ..... A47B 87/008 108/138
6,247,414 B1 * 6/2001 Sikora ..... A47B 87/0223 108/190
D496,809 S * 10/2004 Dardashti ..... D6/675.1
D497,273 S * 10/2004 Harwanko ..... D6/675.1
6,996,929 B1 * 2/2006 Greene, Jr. ..... G09F 7/22 160/368.1
7,066,342 B2 * 6/2006 Baechle ..... B65D 71/0096 206/600
7,093,728 B2 * 8/2006 Chen ..... A47B 57/545 211/187
7,143,534 B2 * 12/2006 Kaminski ..... G09F 7/22 40/606.15
D588,379 S * 3/2009 Chung ..... D6/675.1
7,516,856 B2 * 4/2009 Lee ..... A47B 88/975 211/184
D615,777 S * 5/2010 Lee ..... D6/675.1
7,984,680 B1 * 7/2011 Tsai ..... A47B 87/0223 108/53.5
8,001,911 B2 * 8/2011 Yankello ..... A47B 87/0246 108/190
8,215,246 B2 * 7/2012 Quam ..... E04H 3/28 108/159.11
9,138,079 B2 * 9/2015 Su ..... A47B 87/0215
10,092,099 B1 * 10/2018 Linari ..... A47B 61/04
2002/0000418 A1 * 1/2002 Miller, Jr. ..... A47F 5/0018 211/186
2007/0108149 A1 * 5/2007 Lee ..... A47B 47/0083 211/187
2007/0205173 A1 * 9/2007 Garman ..... D06F 58/00 211/188
2008/0302748 A1 * 12/2008 Tsai ..... A47B 45/00 211/188
2009/0107938 A1 * 4/2009 Miller, Jr. ..... A47F 3/0404 211/133.6
2013/0048588 A1 * 2/2013 Vilkomirski ..... A47B 87/0223 220/4.01
2013/0055604 A1 * 3/2013 Herman Baran ..... A47B 45/00 40/606.03
2013/0221818 A1 * 8/2013 Ceballos Godefroy ..... A47B 43/00 312/258
2014/0217690 A1 * 8/2014 Schumaker ..... B62B 5/00 280/47.35
2014/0353271 A1 * 12/2014 Kruse ..... A47F 5/01 211/188
2015/0191961 A1 * 7/2015 Yang ..... E06B 3/221 428/34.5
2015/0216299 A1 * 8/2015 Lai ..... A47B 87/0223 211/194
2015/0323105 A1 * 11/2015 Lee ..... F16L 9/14 138/140
2015/0330430 A1 * 11/2015 Krieger ..... F16B 12/50 403/286
2015/0335173 A1 * 11/2015 Lee ..... A47B 47/0091 211/186
2016/0015177 A1 * 1/2016 Blake ..... A47B 87/02 108/156
2016/0157605 A1 * 6/2016 Grad ..... A47B 91/024 108/189

(56) References Cited

U.S. PATENT DOCUMENTS

| | | | | |
|---|---|---|---|---|
| 2016/0236305 | A1* | 8/2016 | Winnicka | A47B 87/0223 |
| 2018/0146777 | A1* | 5/2018 | Henonin | A47B 87/008 |
| 2020/0100588 | A1* | 4/2020 | Reinhart | A47B 87/0215 |

FOREIGN PATENT DOCUMENTS

| | | | | | |
|---|---|---|---|---|---|
| CN | 206197701 | U | * | 5/2017 | A47B 47/0083 |
| DE | 202015105519 | U1 | * | 12/2015 | A47B 47/0083 |
| EP | 0101647 | A2 | * | 2/1984 | A47B 87/0223 |
| EP | 593407 | A1 | * | 4/1994 | A47B 47/042 |
| EP | 0593848 | A1 | * | 4/1994 | A47B 87/0223 |
| EP | 1982622 | A1 | * | 10/2008 | A47F 5/01 |
| GB | 2260076 | A | * | 4/1993 | A47B 87/0223 |
| GB | 2531553 | A | * | 4/2016 | A47B 47/06 |
| GB | 2547626 | A | * | 8/2017 | A47B 47/0008 |
| WO | WO-03065850 | A1 | * | 8/2003 | A47B 49/006 |
| WO | WO-2017181224 | A1 | * | 10/2017 | A47B 87/0223 |

* cited by examiner

CONFIGURABLE AND DISMANTLABLE DISPLAY CASE SYSTEM AND METHOD OF ASSEMBLY

CROSS REFERENCE TO RELATED APPLICATIONS

This application is a continuation-in-part application of U.S. nonprovisional patent application Ser. No. 15/737,941 filed on Dec. 19, 2017, which is national phase nonprovisional patent application of PCT/CL2016/000029 filed on Jun. 13, 2016, which claimed the benefit of Chile application serial number 1832-2015 filed on Jun. 24, 2015. The foregoing applications are incorporated in their entireties herein by reference.

FIELD OF THE INVENTION

The present invention relates to a configurable, dismantlable display case system, with specific supports for promotional graphics, particularly suited for use as a display cabinet, which may be used in all types of shopping malls, fairs and promotional events, the constitution thereof being simple and entailing a reduced cost, and with the possibility of changing the promotional campaign thereon as many times as may be necessary.

BACKGROUND OF THE INVENTION

Promotional campaigns for certain articles are very common at stores; usually of limited duration and basically involving positioning or locating the articles publicized in a prominent or notable location, by means of shelving distinguishable from the remainder.

These campaigns are of limited duration; the cabinet used for the same therefore has a limited validity or life. It is therefore advisable to employ a simply-configured cabinet entailing a reduced cost which, in spite of the foregoing, provides the characteristics of safety and appearance necessary for the purpose for which it is intended.

The modular shelving unit of the present invention is an array of devices that configure a modular, assemblable shelving unit, this being the solution to the main problems and difficulties entailed by previous assemblable shelving units for the display of products at sales outlets, these being: the disposability of the cabinet, the impossibility to configure the same according to the space available and the inexistence of specialized supports for promotional campaigns.

Currently, the companies that manufacture assemblable shelving units used for the displaying of products in sales outlets only provide the basic structure of the shelving unit, i.e. a tray with housings for the installation of pillars, which can only be installed individually, either higher or lower. The latest developments seen include special housings for the installation of promotional graphics, enabling the continued use of the cabinet, since the replacement of the publicity simplifies the change thereof with no detriment to the shelving unit.

Notwithstanding the aforesaid, the main problem still presented by the most modern shelving units is that it is difficult to configure the same horizontally in order to cover larger surfaces.

Until the present, one solution has been to affix one shelving unit to another by means of cables or cords. Another advantageous solution known is a shelving unit with trays of a trapezoidal outline, which includes cylindrical pillars enabling the coupling of the trays at different levels, joined at their corners by means of clamps; this solution enables the lateral configuration of the shelving units, by joining the trays at a single pillar by means of the clamps; however, not all configurations permit the determination of trays on the same plane, nor is there a possibility of including interchangeable promotional graphics.

With regard to the known prior art, there exists a need for a visually attractive modular display system with appropriate characteristics for its use in all types of shopping malls, fairs and promotional events, which may be configured in a wide variety of shapes and sizes, is simple to assemble and dismantle, with interchangeable publicity and at a reduced cost.

SUMMARY

The principal object of the present invention is to provide a modular display system with constructional characteristics that enable the display of a wide variety of products to users.

Another object of the present invention is to define an assemblable, modular display system, in such a way that a wide variety of shapes and sizes of display systems may be defined.

Yet another object of the present invention is to define a system for the displaying of products that enables the incorporation of interchangeable promotional graphics, enabling the same display unit to alternate between different products, with no detriment to the shelving and dispensing totally with adhesives, thus enabling the re-use of the display unit in successive promotional campaigns.

And yet another object of the present invention is to define a system for the displaying of products that is pleasing to the eye.

And yet another object of the present invention is to define a display system that enables the illumination of the products displayed.

In general, the modular display system which is the object of the present invention includes a plastic shelving unit, with trays at different levels, linked at their corners by means of pillars of a generally triangular profile which fit adjustedly into corresponding housings, one at each corner and on both sides of each tray.

The trays feature a flat upper surface of a generally quadrangular shape and with a predetermined thickness, defining a frontal edge, a rearward edge and lateral edges, on which the products to be displayed are placed. The trays are preferably manufactured from PP (polypropylene).

The tray includes a flat, quadrangular horizontal surface, on which the products to be displayed are placed, and an external wall, perpendicular to the flat surface, and whose medial line is marked by the external line of the square horizontal surface of the tray. The internal side of the wall, above the tray, is that which retains the products displayed, while the internal half of the wall, below the tray, features internal ribs which endow the tray of the device with structure, rigidity and strength. The housing at each corner is of a generally triangular shape with rounded corners, being visible and functional from both above and below the tray. The purpose of this housing is that each shall bear the pillars, which are of the same caliber as the housing, inserted from above or from below the tray, for the assembly of the shelving unit.

Furthermore, at the centre of the trays four housings are defined, for pillars closely facing each other; these four housings are also intended to receive and hold the profiles, but only from above the tray, thus enabling the configuration of new levels for the shelving unit, or the installation of promotional graphics.

Each tray further features at its corners male-female connecting means, whose purpose is to laterally connect corresponding shelving units one to another. The male-female connecting means are located vertically at the lateral edges of each tray, at one extremity a female connector and at the other extremity a male connector, at the four lateral edges.

The connectors enable the horizontal interconnection between trays, enabling the modular shelving units to adapt to the space available in each sales outlet, since the interconnection facilitates the horizontal growth of the shelving units on the display premises. These connectors are a male connector and a female connector, alternating on the external side of each corner of the tray.

The pillars are formed by two types of extruded PVC profiles, designed to slot into all the triangular housings of the tray (at the corners or centrally). Assembly of the pillars and the housings of the tray is performed by press-fitting, inserting the profile into the housing in question and pressing said profile until it butts against the stop at the base of the housing. The shape of the profile is generally triangular with rounded extremities, causing the profiles to slot exactly into the housings of the tray, ensuring the firmness and rigidity of the shelving unit thus formed. All the profiles feature perforations, which are used for the riveting of graphics or anti-theft protective plates. The perforations may also be used for the passage of the lighting cables. Notwithstanding that the profiles are standardized, they may be sized to measure, in the event that the product to be displayed be particularly high and should require a greater space between one tray and another. However, there are two standard lengths of profile: shorter, measuring 150 mm and with four perforations; this profile serves a double purpose, since its reduced length is suited, on the one hand, for the legs of the shelving unit, subsequent to the affixing of a rubber stop or non-slip ferrule manufactured from TPE (thermo-plastic elastomer) to its lower surface to endow the shelving unit with adherence and sustainability. The other function of these profiles is to act as a rail and support for anti-theft protective plates. To this end, the profile features two lateral perforations, located at the flat sides of the profile. On installing this profile in the upper tray of the shelving unit, its lateral perforations enable the affixing thereto of the protective plate. The other standard dimension of the profiles is 350 mm, with six perforations. This profile (and likewise any other profile of greater length) serves to determine the internal height of the shelving unit or the separation between the trays forming the shelving unit, as required by the products to be displayed.

The pillars with a generally triangular profile with rounded corners are extruded, hollow and manufactured from PVC (polyvinyl chloride) stabilised with tin or lead, with pairs of perforations longitudinally spaced on their sides.

At each of the lateral edges of the tray, engaging grooves are also defined, directed longitudinally with regard to a vertical plane, and laterally, departing at an acute angle with regard to this outwardly facing plane of the tray. The distances between grooves are less than the width of the tray and less than a distance between the male-female connectors.

A flat, smooth board may be inserted into the engaging grooves of each tray, being the height of the shelving unit and covering at least one external side of two consecutive trays, assembled with their corresponding pillars. This board serves as a supporting format for the lateral promotional graphics, covering the entire height of the shelving unit and is fixed by tension within the engaging grooves.

At the front edge and the rearward edge of the trays a channel is defined, formed between vertical grooves similar to the grooves at the lateral sides, and a horizontal groove linked to the vertical groove; these grooves act as a supporting channel for a flat, smooth board as for promotional graphics of the price ticket strip type.

In both formats, thanks to the design incorporated in the support for promotional graphics, the design and location of these supports incorporated in the tray solves the problem of affixing the promotional graphics by means of adhesives, this now being unnecessary, thus facilitating the indefinite re-use of the product display device at sales outlets and enabling a total change of promotional graphics, it only being necessary to change the boards and price ticket strips.

The incorporation of the aforementioned lateral connectors enables the horizontal configuration of the shelving units, with the advantage that on termination of their use they may be dismantled or even remodeled into a different configuration.

Another device featured by the tray is the channel or housing for LED (light emitting diode) lighting. Two lateral channels have been incorporated on the surface of the tray, located at opposing internal edges of the tray, just inside the location of the price ticket strip-like supports. These channels are of the same width as an LED strip and are angled at 452 to facilitate the illumination of the products placed in the shelving unit. Thanks to this solution, it is now possible to install a LED strip in each channel, enabling the illumination of the products displayed.

The LED strip is installed throughout the length of the cavity and its cables may be routed through the interior of the shelving unit to the floor, through perforations especially located in both the trays and the extruded profiles.

The design of the tray also features specific perforations for the cabling of the module with the LED strips. The perforations are located at each extremity of the illumination channels and enable the cable to be routed toward the lower part of the shelving unit for its connection to the power source. In addition, all the housings for the insertion of pillars feature a perforation at their base, executed for the passage thereby of the cables and their downward routing.

The shelving unit is assembled commencing with the tray featuring its housings and a set of pillars or structural profiles which are inserted into the housings of the tray to assemble the shelving unit desired. Similarly, by means of the connectors at the lateral edges of each tray, the trays may be assembled horizontally, to form larger shelving units, covering a greater space within the sales outlet in which it is used.

The anti-theft plate is defined as an accessory and includes a rectangularly shaped sheet of polycarbonate, cut to the width of the vertical pillars of the cabinet and perforated in order to fit together with the standard perforations of the extruded profiles.

Another accessory is the diagonalization adaptor, which includes a solid item of plastic, designed to be inserted so as to join two horizontal female connectors of the tray, thus enabling the joining of several shelving units to form a diagonally staggered line. Yet another accessory is a foot to be installed at the underside of a tray, featuring a generally triangular profile and with an internal threaded hole for the installation of castors, thus to configure a mobile shelving unit.

Finally, the tray further incorporates symbols for the identification of faces or sides. To facilitate assembly and the identification of the faces of the tray, said tray distinguishes with a plus sign (+) the sides featuring the support for the price ticket strip graphics, and with a minus sign (−) the sides on which the supports for lateral graphics are located.

Accordingly, the invention features a configurable, dismantlable display case system, with supports for promotional graphics, particularly suited for use as a display cabinet, and with the possibility of changing a promotional campaign thereon as many times as may be necessary. The display case system includes a shelving unit, which features: (i) trays at different levels, wherein the trays are linked at their corners by pillars of a generally triangular profile with rounded corners, which fit adjustedly into corresponding housings in the tray, wherein blind housings are located one at each corner and on upper and lower sides of each tray. Each tray includes a flat, horizontal surface of a generally quadrangular shape and with a predetermined thickness, defining a frontal edge, a rearward edge, and lateral edges, and an external wall, perpendicular to the flat surface, and whose medial line is marked by the external line of each horizontal edge of each tray. Each housing at each corner includes a generally triangular shape with rounded corners, being visible and functional from both above and below the corresponding tray to which the housing is connected. At the center of an upper part of the tray, four housings are defined for pillars closely facing each other. Each tray further includes at its corners male-female connecting means to enable the lateral interlocking of corresponding shelving units. The male-female connecting means are located vertically at the lateral edges of each tray, wherein a female connector is located at one extremity and at the other extremity a male connector, at the four lateral edges. The shelving unit also features: (ii) pillars for slotting into the triangular housings of the tray (at the corners or centrally) and including perforations located spacedly at their sides; (iii) short profiles or legs, of a more reduced length than the pillar profiles, of a generally triangular shape with rounded corners which slot adjustedly into corresponding housings of the tray (at the corners or centrally) and also including perforations located spacedly at their sides; and (iv) non-slip ferrules inserted into the profile forming the leg.

In another aspect, the invention can feature the short profiles including four perforations spacedly located on their sides.

In another aspect, the invention can feature the pillar profiles including six perforations spacedly located on their sides.

In another aspect, the invention can feature the pillars having a generally triangular profile with rounded corners and are extruded and hollow.

In another aspect, the invention can feature at each of the lateral edges of the tray, engaging grooves being also defined, directed longitudinally with regard to a vertical plane, and laterally, departing at an acute angle with regard to this outwardly facing plane of the tray, with the distances between grooves being less than a width of the tray and less than a distance between male-female connectors.

In another aspect, the invention can feature at the front edge and the rearward edge of the trays, a channel being defined, formed by a pair of vertical grooves and a horizontal groove.

In another aspect, the invention can further include a flat, smooth board of the same height as the shelving unit, as a supporting format for the lateral promotional graphics, covering the entire height of the shelving unit and fixed by tension between the grooves.

In another aspect, the invention can feature a flat, smooth board of the same height as the trays, as a supporting format for price ticket strip-type promotional graphics, fixed by slotting into the channel.

In another aspect, the invention can feature the tray including on its upper surface two channels or housings for LED (light emitting diode) lighting, located at the front edge and rearward edge of each tray, angled to facilitate the illumination of the products loaded in the shelving unit.

In another aspect, the invention can feature the LED strip being installed throughout the length of the channel and its cables being routed through the interior of the shelving unit to the floor, through perforations located in both the tray and the profiles.

In another aspect, the invention can feature the perforations for the cabling of the module with LED strips being located at each extremity of the illumination channel and enabling the cable to be routed toward the lower part of the shelving unit for its connection to the power source. In addition, all the housings for the insertion of pillars can include a perforation at their base, executed for the passage thereby of the cables and their downward routing.

In another aspect, the invention can feature a rectangularly shaped anti-theft sheet of polycarbonate, cut to the width of the tray and perforated in order to fit together with the standard perforations of the extruded profiles.

In another aspect, the invention can feature a diagonalization adaptor, a device that includes a solid item of plastic, with a profile corresponding to the male connector of the tray, designed to be inserted so as to join two horizontal female connectors of the tray, thus enabling the joining of several shelving units to form a diagonally staggered line.

In another aspect, the invention can feature a foot for the installation of castors or of a circular plate acting as a tray. The foot is of a generally triangular profile with rounded corners and includes an internal threaded hole, and with a height equal to the depth of the housing.

In another aspect, the invention can feature the circular plate acting as a tray, by means of the foot and a number of studs, being installed in the central housings of each tray, enabling the generation of another surface above the tray for the placement of products to be displayed.

In another aspect, the invention can feature a connecting device formed by a plate, which follows the outline of the triangular profile with rounded corners, and including one part with a flat surface which couples to an elongated rectangular plate, enabling the installation of boards with promotional graphics thereon.

A method of the invention can be used for the assembly of a configurable, dismantlable display case system, with supports for promotional graphics, and with the possibility of changing a promotional campaign thereon as many times as may be necessary. The method includes the steps of: (a) supplying a tray having a flat, generally quadrangular horizontal surface, and with a predetermined thickness defining a frontal edge, a rearward edge and lateral edges, on which the products to be displayed are placed, and an external wall, perpendicular to the flat surface; each tray further including at its corners male-female connecting means, enabling the lateral interlocking of corresponding shelving units; the male-female connecting means being located vertically at the lateral sides of each tray, at one extremity a female connector and at the other extremity a male connector at the four lateral edges; with housings at each corner of a generally triangular shape with rounded corners, both above and below the tray; (b) supplying pillars, which slot into the triangular housings of the tray, wherein the pillars include perforations spacedly located at their sides; (c) supplying legs or short profiles having a more reduced length than the pillar profiles, with a generally triangular shape and with rounded corners, which slot adjustedly into the corresponding housings of the tray and also including perforations spacedly located at their sides; (d) installing non-slip ferrules on the legs; (e) assembling the legs below a quadrangular tray having a flat upper surface and triangular housings with rounded extremities at each corner of its upper and lower faces; (f) assembling pillars at each corner of the tray; said pillars being formed by profiles generally having a triangular cross-section and being hollow, with rounded extremities; (g) installing another tray on the pillars, with its flat surface facing upwards; and (h) repeating steps (f) and (g) until a shelving unit of the desired height is obtained.

Another method of the invention can include the step of (i) assembling two shelving units by means joining the male-female connectors defined at the lateral sides of each tray, in such a way that a twin-section shelving unit is formed, be the sections of the same height or of different heights.

Another method of the invention can include the step of (j) assembling three or more shelving units by joining the male-female connectors defined at the lateral sides of each tray, forming shelving units of three, four or more sections, forming rectangular, square or L-shaped shelving units, each section being of the same height or of different heights, to create larger shelving units, covering a greater area within the sales outlet where they are employed.

Another method of the invention can include the step of (k) installing feet, to be installed in triangular housings on the underside of a tray; each foot having a generally triangular profile with a threaded hole for the installation of castors, thus to configure a mobile shelving unit.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

BRIEF DESCRIPTION OF THE DRAWINGS

As a supplement to the description made herein, and for the purpose of aiding the better understanding of the characteristics of the invention, in accordance with preferred examples of a practical embodiment of the same, a set of drawings is attached as an integral part of said description wherein, by way of illustration and not limitation, the following is portrayed.

DETAILED DESCRIPTION

Figure 1:
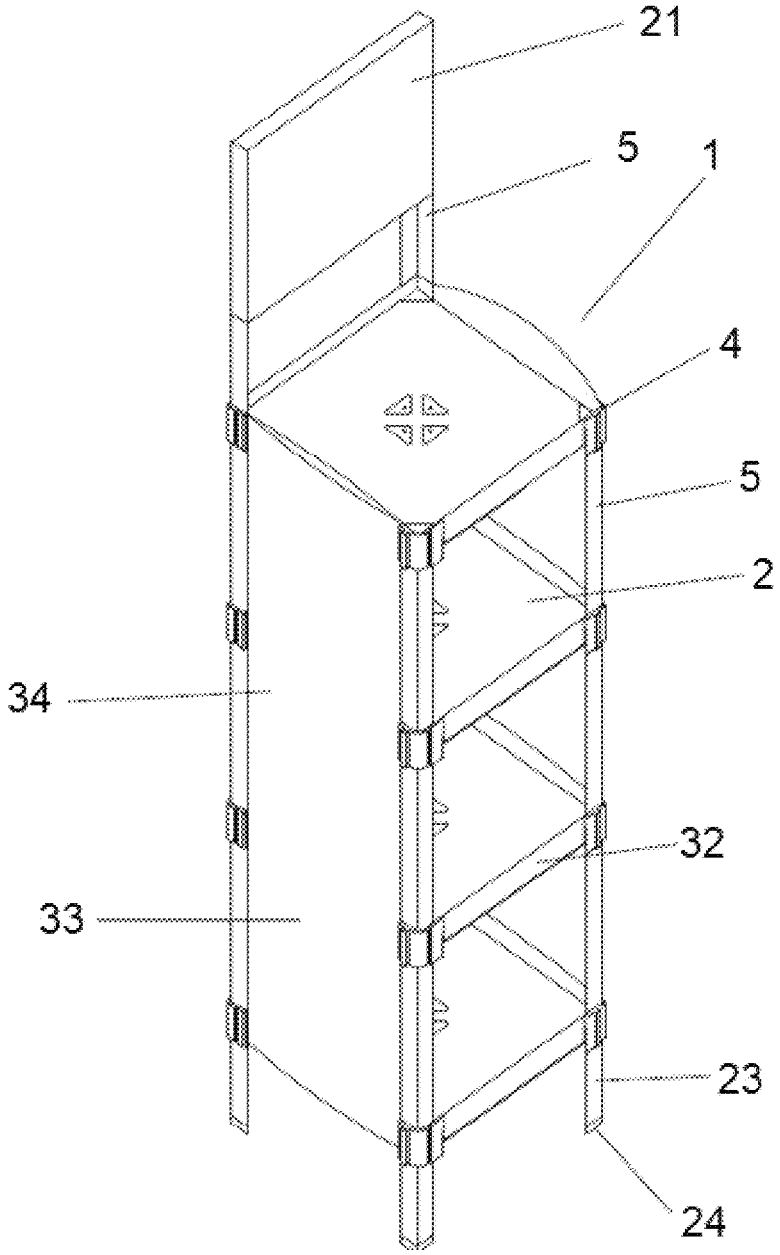
FIG. 1 portrays an isometric view of the shelving unit which is the object of the invention, in an assembled state and with the configuration of a simple shelving unit.
Figure 2:
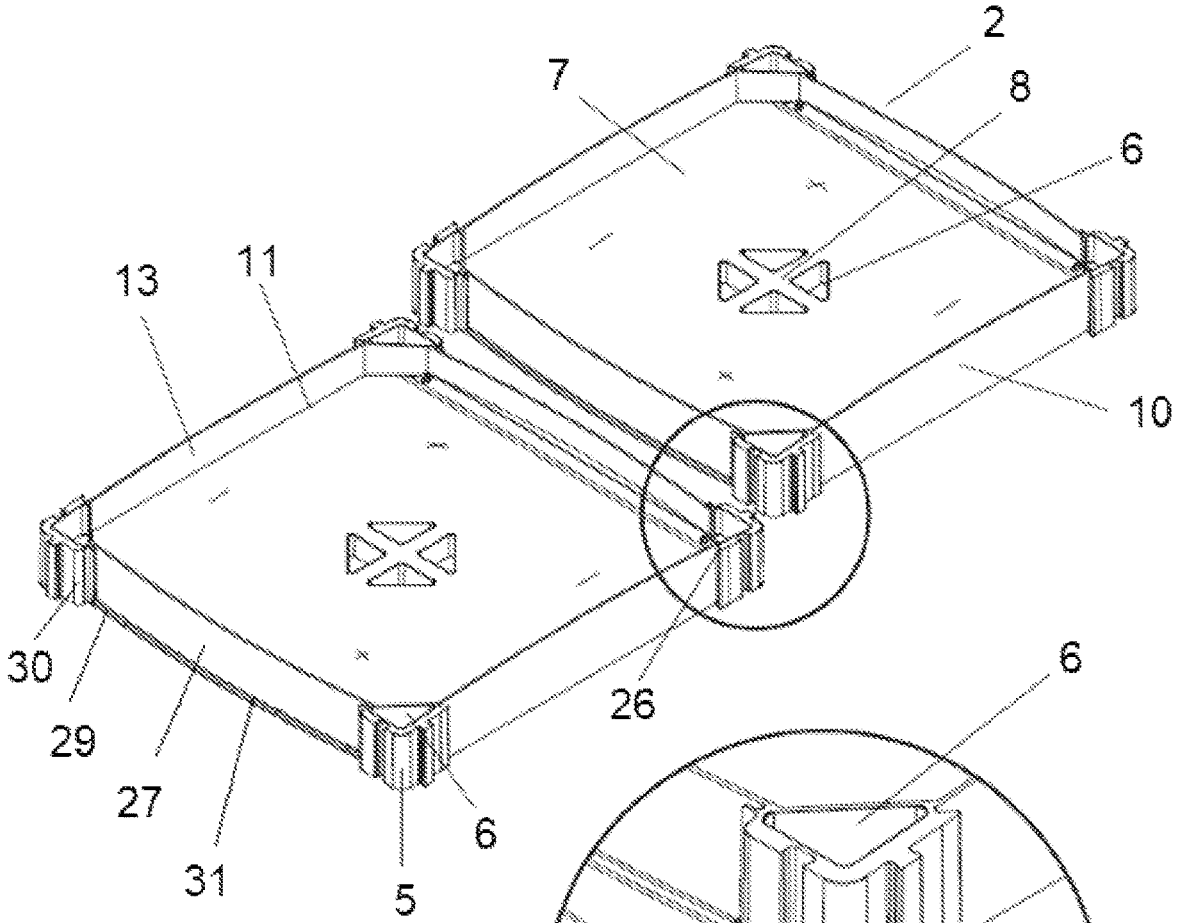
FIG. 2 portrays an isometric view of a tray and the means for its connection by slotting together with another tray of like characteristics.
Figure 3:
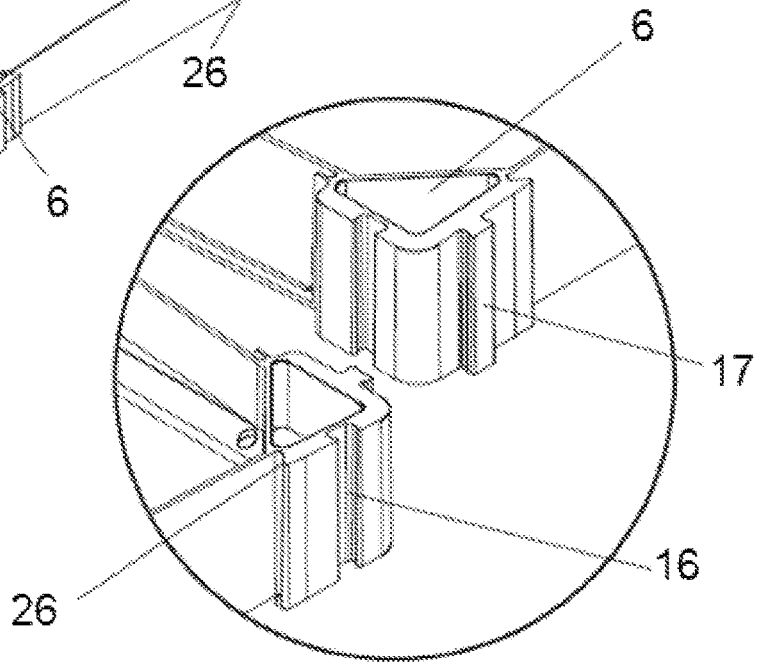
FIG. 3 portrays an enlarged view of the slotting together portrayed in FIG. 2.
Figure 4A:
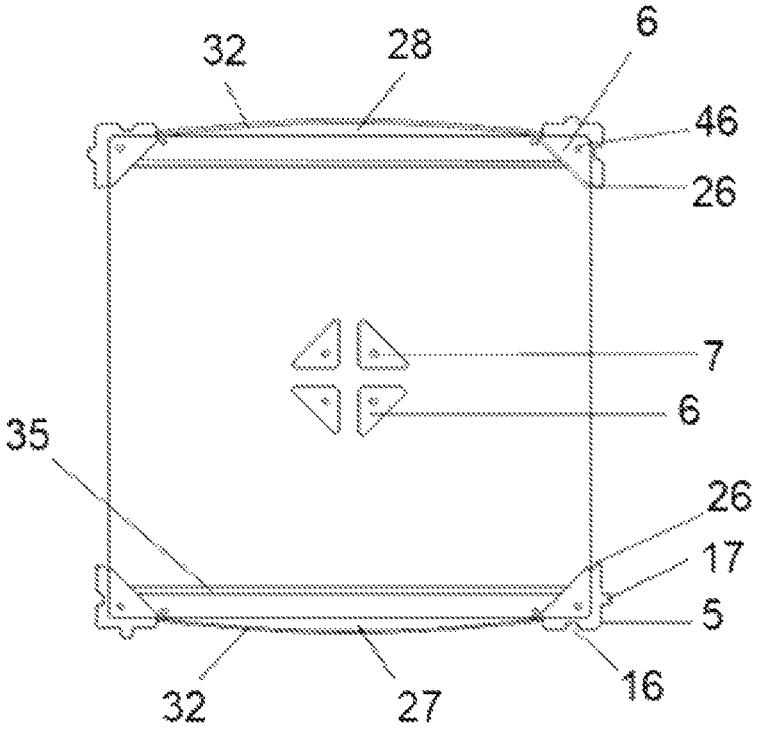
FIG. 4*a* portrays a view from above of the tray which is the object of the invention.
Figure 4B:
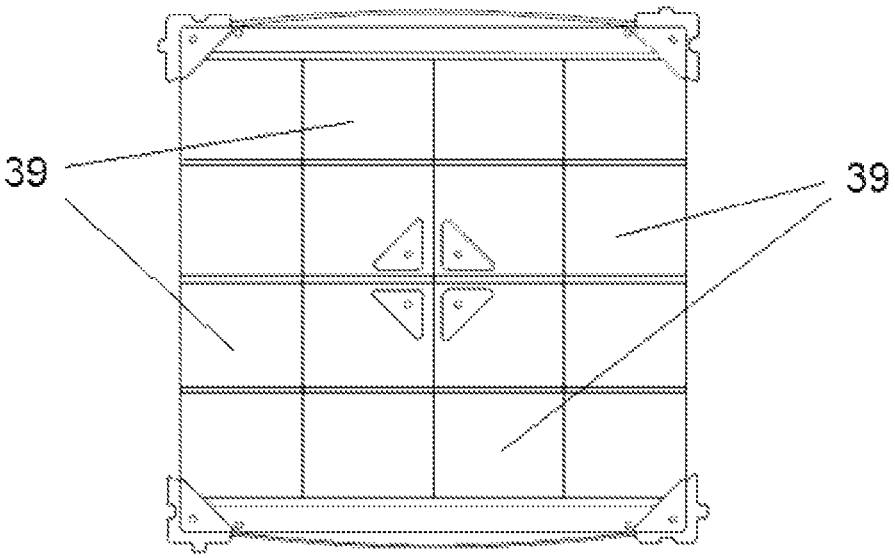
FIG. 4*b* portrays a view from above of the tray which is the object of the invention, displaying its identifying symbols.
Figure 5:
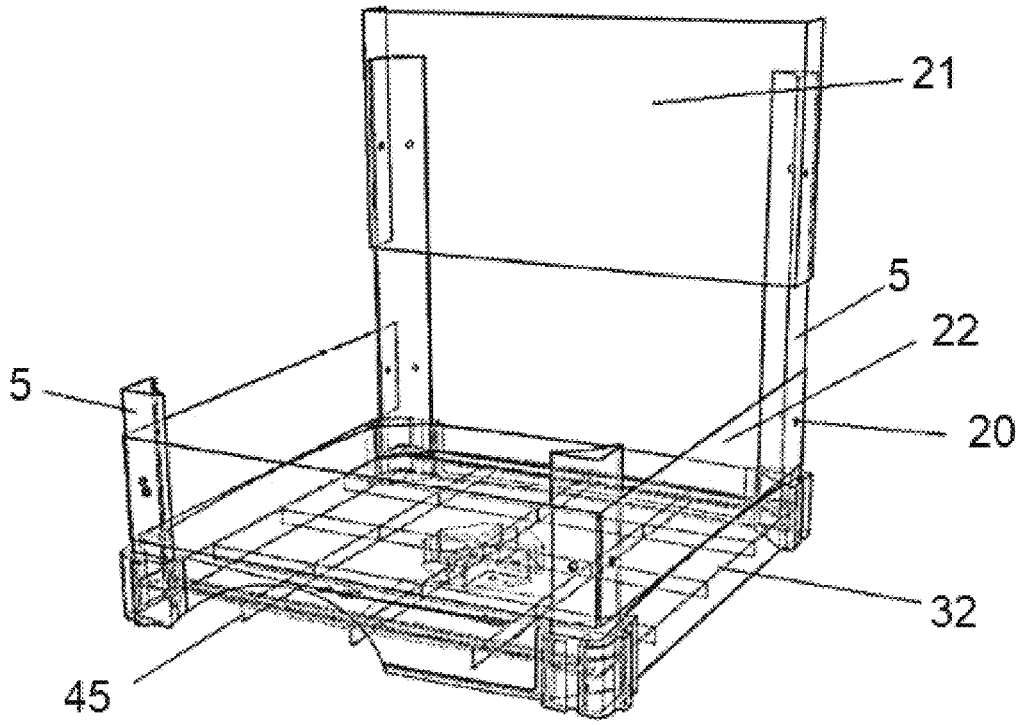
FIG. 5 portrays a detail of an isometric view of the pillars with protective plates.
Figure 6:
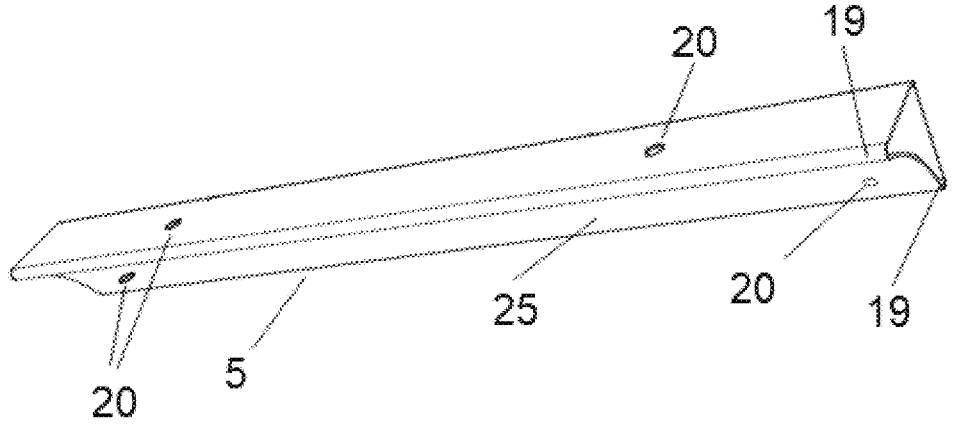
FIG. 6 portrays an isometric view of a pillar or triangular profile.
Figure 7A:
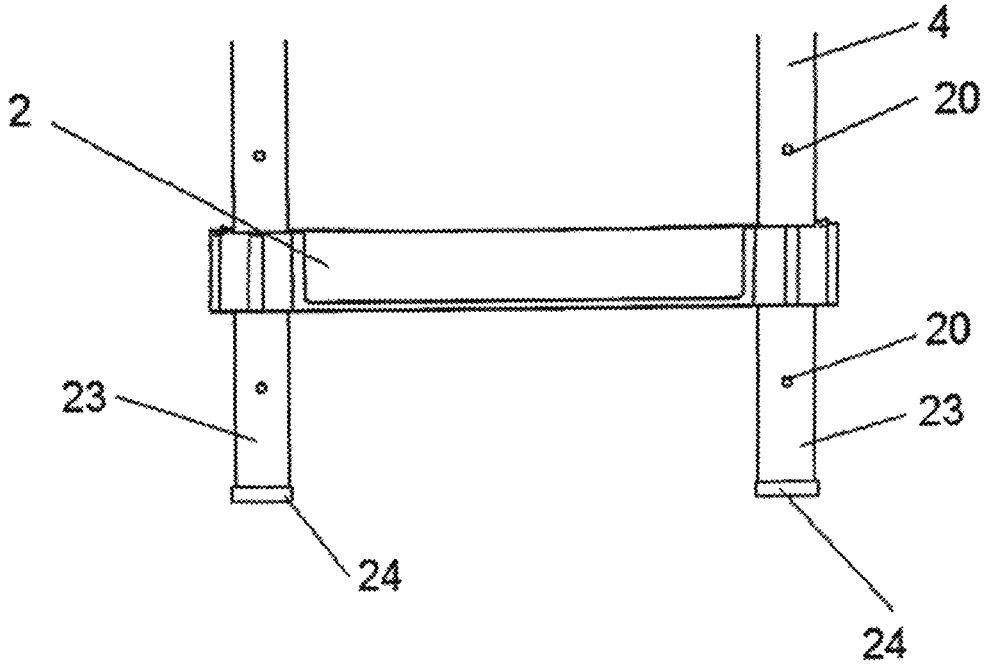
FIG. 7*a* portrays a front view of the legs of the shelving unit including non-slip elements or ferrules.
Figure 7B:
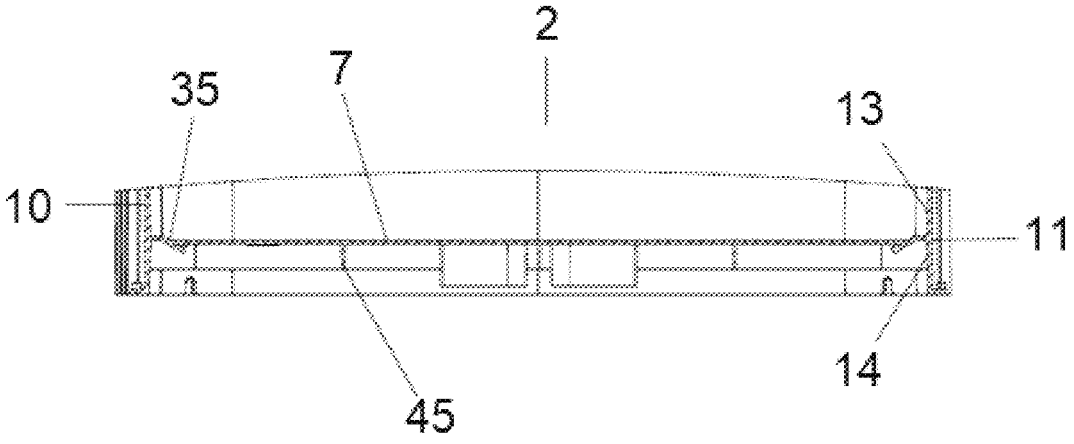
FIG. 7*b* portrays a cross-sectional view of the central part of a tray.
Figures 8A, 8B:
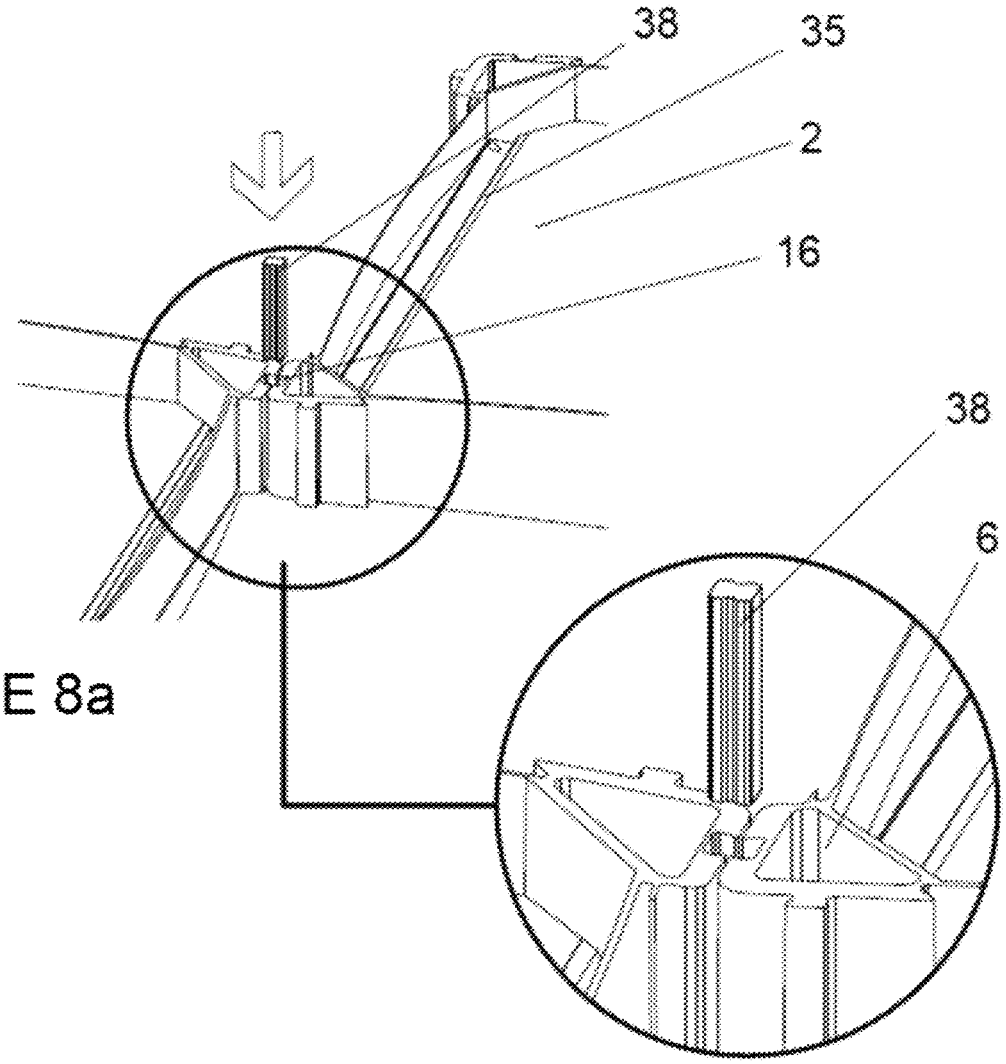
FIG. 8*a* portrays an isometric view of a diagonalized coupling between trays.
FIG. 8*b* portrays a close-up isometric view of a diagonalized coupling between trays.
Figure 9:
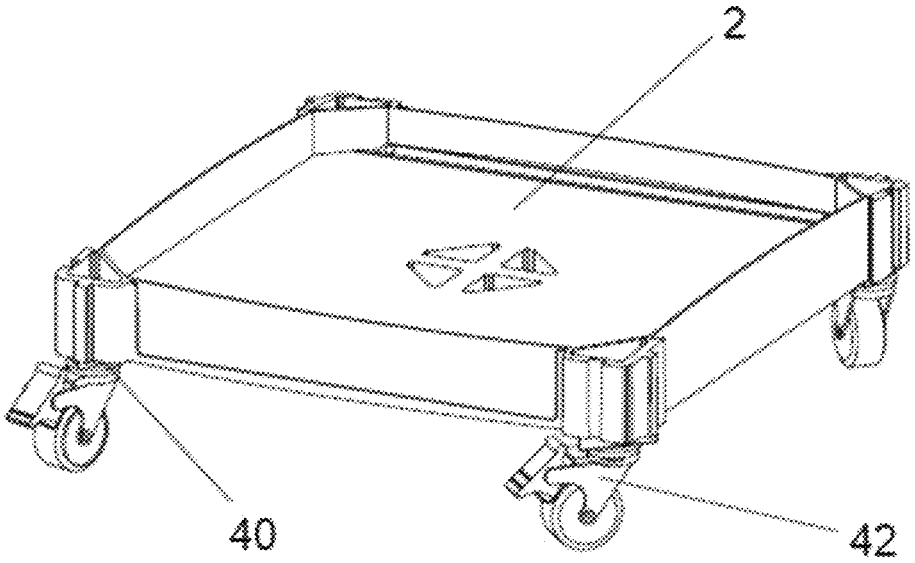
FIG. 9 portrays an isometric view of a tray equipped with castors.
Figure 10:
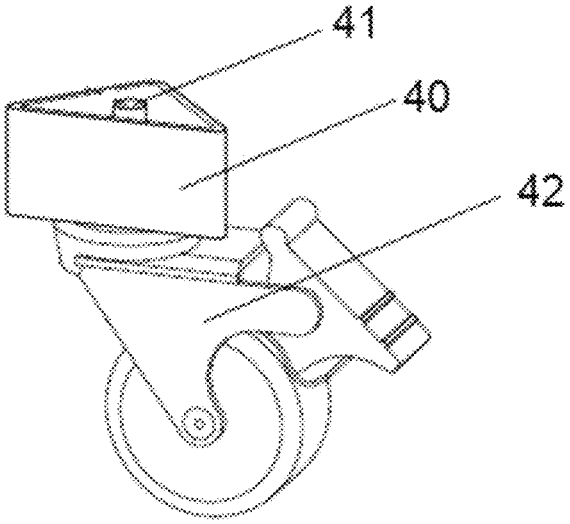
FIG. 10 portrays an isometric view of the accessories for the installation of castors.
Figure 11:
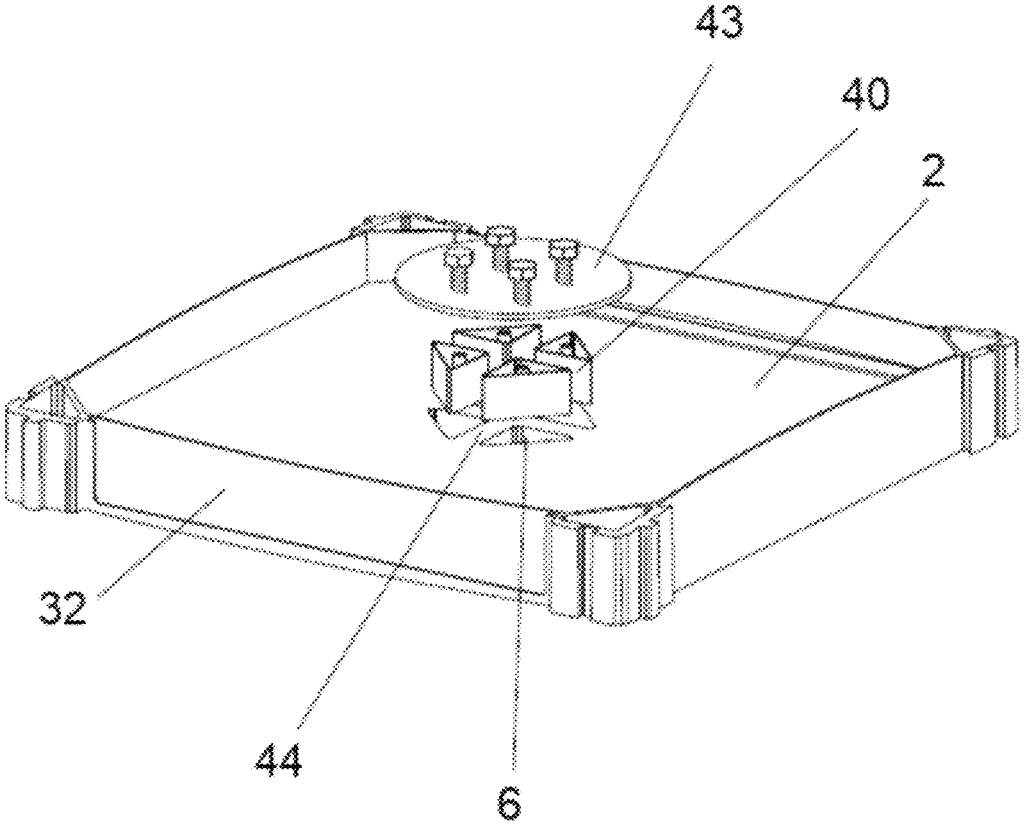
FIG. 11 portrays an isometric view of a tray equipped with the accessories denominated foot and circular plate installed at its central part.
Figure 12:
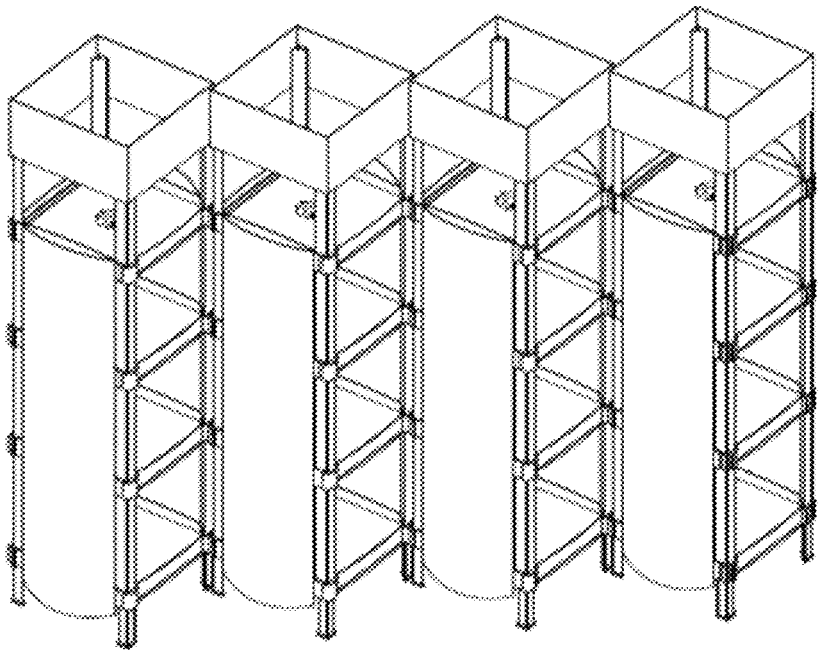
FIG. 12 portrays an isometric view of a diagonal configuration of shelving units.
Figure 13:
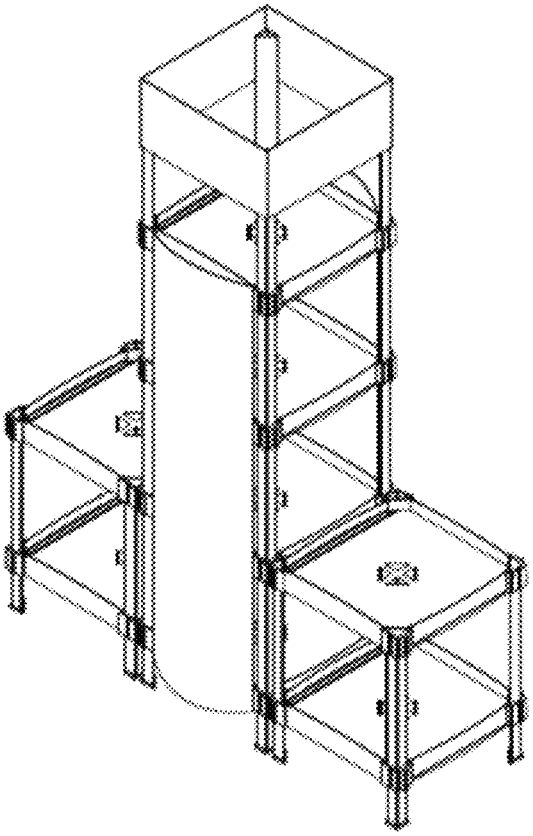
FIG. 13 portrays an isometric view of a configuration denominated shelving dump bin.
Figure 14:
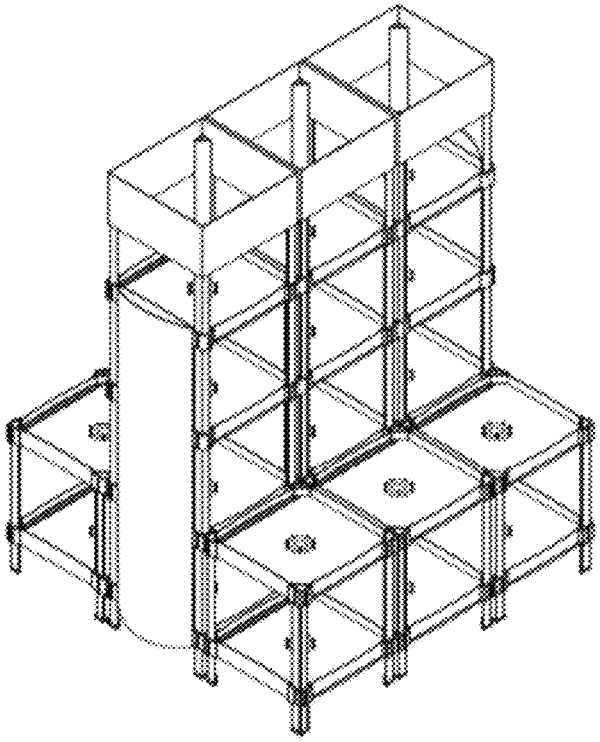
FIG. 14 portrays an isometric view of a configuration of three units denominated triple dump bin.
Figure 15:
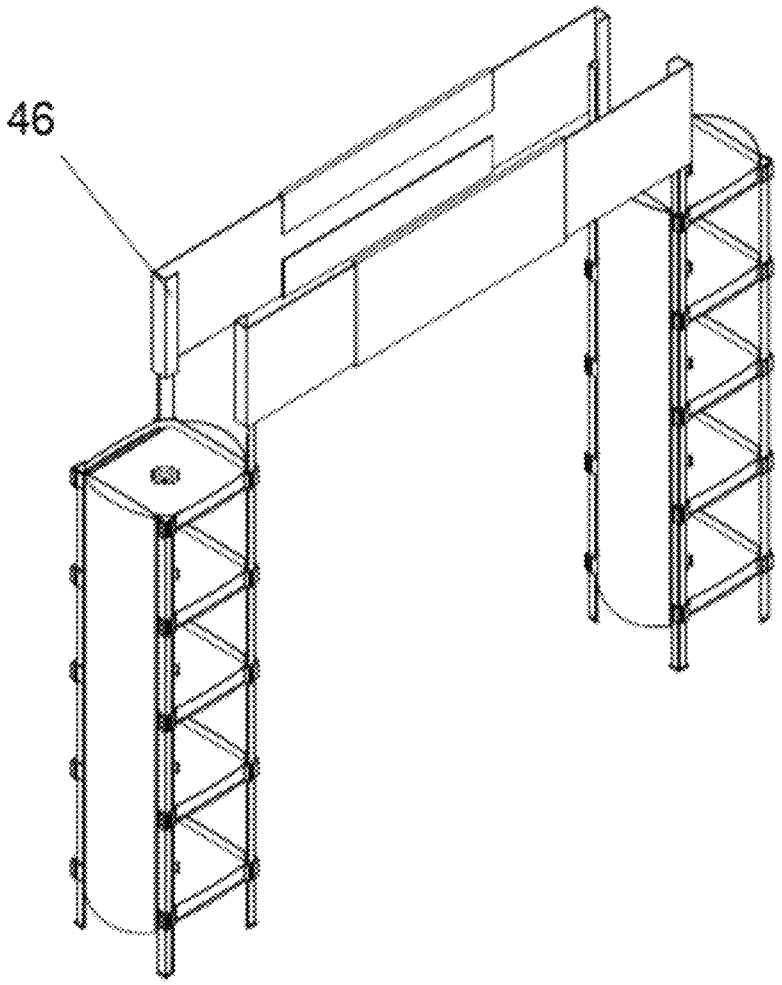
FIG. 15 portrays an isometric view of a so-called arch-shaped configuration, useful at exhibition stands.

The present invention will now be described hereunder in greater detail, with reference to the attached drawings, portraying the preferred modalities of the invention. This invention may, however, be expressed in many different ways and it should not be interpreted as being limited to the modalities indicated herein. Instead, these modalities are implemented herein in order that said disclosure be thorough and complete, and describing to the full the scope of the invention for those skilled in the art. Identical numbers refer to identical elements throughout the document.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The modular display system 1 which is the object of the present invention is a shelving unit having trays 2 at different levels, joined at their corners 4 by means of pillars 5 of a generally triangular profile with rounded corners which slot adjustedly into corresponding housings 6, one at each corner 4 and on both sides of each tray.

The housing 6 at each corner is of a generally triangular shape, featured on both sides of the tray 2. The purpose of this housing 6 is that each shall hold the pillars 5, these being of the same caliber as the housing 6, and are inserted from above and/or from below, for assembly of the shelving unit.

Additionally, at the centre 8 of the trays 2, four housings 6 are defined for pillars closely facing each other; these four housings are also intended to receive and hold pillars, but only from the flat upper surface 7 of the tray 2.

The tray 2 includes a flat, horizontal, quadrangular surface 7 on which the products to be displayed are located, and an external wall 10, perpendicular to the flat surface 7 and whose medial line 11 is marked by the external line of the square, horizontal, flat surface 7 of the tray. The trays 2 are preferably manufactured from PP (polypropylene). One internal side of the wall 13, above the tray 2, is that which retains the products displayed, while the internal half of the wall 14, below the tray 2, features internal ribs 45 which endow the tray 2 of the device with structure, rigidity and strength.

Each tray 2 further features at its corners 4 male-female connecting means 16, 17, to laterally connect the shelving units. The male-female connecting means 16, 17 are located vertically at the edges of each tray 2, at one extremity a female connector 16 and at the other extremity a male connector 17, at the four edges of the external wall 10.

The pillars 5 are formed by two types of extruded PVC profiles, designed to slot into the triangular housings 6 of the tray (at the corners or centrally). Assembly of the pillars 5 and the housings 6 of the tray 2 is performed by press-fitting, inserting the pillar 5 into the housing 6 and pressing said profile until it butts against the stop at the base of the housing. The shape of the profile is generally triangular with rounded extremities 19, causing the profiles to slot exactly into the housings of the tray, ensuring the firmness and rigidity of the shelving unit thus configured.

The pillars are described herein as being made from polyvinyl chloride (PVC) for purposes of convenience and not as a limitation. In various embodiments of the systems and devices described herein, the pillars may be constructed from polypropylene (PP), recycled polypropylene (PP), polyethylene terephthalate (PET), recycled polyethylene terephthalate (PET), polyethylene (PE), recycled polyethylene (PE), any other suitable plastic, or a combination of two or more of these materials. Other components of the system may also be made and constructed from polyvinyl chloride (PVC), polypropylene (PP), recycled polypropylene (PP), polyethylene terephthalate (PET), recycled polyethylene terephthalate (PET), polyethylene (PE), recycled polyethylene (PE), any other suitable plastic, or a combination of two or more of these materials.

All the profiles feature perforations 20, which are used for the riveting of graphics 21 and/or anti-theft protective plates 22. The perforations 20 may also be used for the passage of the lighting cables.

Notwithstanding that the profiles are standardized, they may be sized to measure, in the event that the product to be displayed be particularly high and should require a greater space between one tray and another. There are two standard lengths of profile or pillar: the shorter, measuring 150 mm and with four perforations, and another of 350 mm. The first serves a double purpose, since its reduced length is suited, on the one hand, for the legs 23 of the shelving unit, to the underside of which a non-slip rubber ferrule 24 is attached to endow the shelving unit with adherence and sustainability. The other function of the short profiles is to act as a rail and support for the anti-theft protective plates 22. To this end, the profile features the two lateral perforations 20, located on the flat surfaces of the profile.

The other standard dimension of the profiles is 350 mm, with six perforations, and this profile, and likewise any other profile of greater length, serves to determine the internal height of the shelving unit or the separation between the trays forming the shelving unit, as required by the products to be displayed. The pillars 5 with a generally triangular profile are extruded, hollow and manufactured from PVC (polyvinyl chloride) stabilised with tin or lead, with pairs of perforations 20 longitudinally spaced on their perpendicular sides 10, 11 and diagonal side 25.

Although 150 mm is the length of the shorter profiles (also referred to as a foot or display foot of the shelving unit) in some exemplary embodiments of the system, in various other embodiments of the system, the shorter profiles of the pillars can have a length of about 50 mm to about 250 mm. Likewise, although 350 mm is the length of the longer pillars in some exemplary embodiments of the system, in various other embodiments of the system, the longer profiles of the pillars can have a length of about 200 mm to about 500 mm.

In the trays, and at the lateral edges of the external wall 10, rectangular engaging grooves 26 are also defined, directed longitudinally with regard to a vertical plane, and laterally, departing at an acute angle with regard to this outwardly facing plane of the tray 2. The distances between grooves 26 are less than the width of the tray 2 and less than a distance between the male-female connectors 16, 17.

Furthermore, at the front edge 27 and the rearward edge 28 of the trays a channel 29 is defined, formed between vertical grooves 30 similar to the grooves 26 at the lateral sides, and a horizontal groove 31 linked to the vertical groove 30; grooves that act as a supporting channel for a flat, smooth board as for promotional graphics or for price ticket strips 32.

A flat, smooth board 33 may be inserted into the engaging grooves 26 of each tray 2, being the height of the shelving unit and covering at least one external side of two consecutive trays 2, assembled with their corresponding pillars 5. This board serves as a supporting format for the lateral promotional graphics 34, covering the entire height of the shelving unit and is fixed by tension within the engaging grooves 26.

Another device featured by the tray is a housing for LED lighting. Two lighting channels 35 have been incorporated on the surface of the tray, located at opposing internal edges of the tray 2, just inside the location of the price ticket strip supports 32. These lighting channels 35 are of the same width as an LED strip and are angled at 452 to facilitate the illumination of the products loaded in the shelving unit, enabling the illumination of the products displayed.

The LED strip is installed throughout the length of the lighting channel 35 and its cables may be routed through the interior of the shelving unit to the floor, through perforations especially located in both the tray 2 and the pillars 5.

The design of the tray also features specific perforations for the cabling of the module with the LED strips. The perforations are located at each extremity of the lighting channels 35 and enable the cable to be routed toward the lower part of the shelving unit for its connection to the power source. In addition, all the housings for the insertion of pillars feature a perforation 46 at their base, executed for the passage thereby of the cables and their downward routing.

Another important accessory is the diagonalization adaptor 38, a device that includes a solid item of plastic, designed to be inserted so as to join two horizontal female connectors of the tray, thus enabling the joining of several shelving units to form a diagonally staggered line.

And another accessory is a foot 40 to be installed in the housings at the underside of a tray, said foot featuring a generally triangular profile and a height equal to the depth of the triangular housings 6 in the tray, with an internal threaded hole 41 for the installation of castors 42, thus to configure a mobile shelving unit.

Yet another accessory is a circular plate 43 forming a tray which, by means of the feet 40 is installed in the central housings 44 of each tray 2, enabling the generation of another surface for the placement of products on display.

And yet another accessory is the connecting device 46 formed by a plate which at its lateral edges follows the outline of a triangular profile with rounded corners; this connecting device includes three plates adjustedly sliding together; a first plate or connecting item at one extremity, a central plate and a second plate or connecting item at the other extremity, in such a way that its longitudinal extension may be varied, this enabling the joining of series of shelving units of great height and spacing, by means of pillars assembled on the upper tray of each shelving unit; further enabling, by means of grooves therein, the installation of higher boards bearing promotional graphics, thus forming sizeable exhibition stands.

Finally, the tray further incorporates symbols 39 for the identification of fronts or sides. To facilitate assembly and the identification of the faces of the tray, said tray distinguishes with a plus sign (+) the sides featuring the support for the price ticket strip, and with a minus sign (−) the sides on which the supports for lateral graphics are located.

Advantageously, a method for the assembly of a shelving unit is foreseen wherein: the shelving unit is assembled from structural trays and pillars or profiles, and wherein the method includes the steps of:

(a) installing non-slip ferrules and/or castors on the legs or feet respectively, both of these formed by means of profiles of reduced length with regard to their transverse cross-section; said profiles generally featuring a triangular cross-section and being hollow, with rounded extremities and manufactured from a material such as polyvinyl chloride (PVC), polypropylene (PP), recycled polypropylene (PP), polyethylene terephthalate (PET), recycled polyethylene terephthalate (PET), polyethylene (PE), recycled polyethylene (PE), any other suitable plastic, or a combination of two or more of these materials;

(b) assembling the legs or castors beneath a quadrangular tray featuring a flat upper surface and at each corner thereof, a triangular housing with rounded extremities, at both their upper and lower sides;

(c) assembling pillars at each upper corner of the tray; said pillars generally featuring a triangular cross-section and being hollow, with rounded extremities and manufactured from a material such as polyvinyl chloride (PVC), polypropylene (PP), recycled polypropylene (PP), polyethylene terephthalate (PET), recycled polyethylene terephthalate (PET), polyethylene (PE), recycled polyethylene (PE), any other suitable plastic, or a combination of two or more of these materials;

(d) installing another tray on the pillars, with the flat surface thereof facing upwards; and (e) repeating sequences (c) and (d) until a shelving unit of the desired height is obtained.

In another alternative method, two identical shelving units are assembled by means of the locking together of the male-female connectors defined at the lateral sides of each tray, in such a way that a twin-section shelving unit is formed, be the sections of the same height or of different heights.

Yet other alternatives are enabled by the assembly of the shelving units by means of the male-female connectors, forming shelving units of three, four or more sections, these being rectangular, square or L-shaped, to create larger shelving units, covering a greater area within the sales outlet where they are employed.

In another preferred alternative, in the case of a shelving unit formed by at least four sections linked to form a square, pillars may be installed in one of the central housings of each tray, these being the housings nearest to the center of the four-section shelving unit, to install a tray above the upper four trays, forming an additional level with a single tray, or in the place of the tray to install boards for promotional graphics on the pillars.

And in other alternatives connecting items are employed; these connect triangular profiles with rounded corners, to join series of shelving units of considerable height and widely spaced, enabling the installation of boards with promotional graphics thereon, to form sizeable stands for exhibitions.

Advantageously and preferably, flat, smooth boards with promotional graphics are installed at the lateral sides, between pairs of grooves defined at each lateral edge of the trays, in such a way that the boards cover the entirety of the height of the shelving unit.

In another preferred alternative, in a channel at the front edge of each tray, price ticket strip-like promotional graphics are installed, covering the entirety of the front edge of each tray.

In another alternative, polycarbonate or cardboard anti-theft plates of a width equal to the width between two pillars assembled on a tray are installed; here, the plates are secured by holders in corresponding perforations between the anti-theft plates and the pillars.

And in another alternative, pillars are installed at the corners of the upper tray of each shelving unit; a flat board with promotional graphics is installed between these pillars, the board being secured to the profiles by holders.

The use of an item denominated diagonalization adaptor is foreseen; this enables the assembly of shelving units touching only at their corners; thus, the shelving units adopt a diagonally staggered configuration.

It is also foreseen that the foot, which features a generally triangular profile, may feature an internal threaded hole for the installation of the castors, thereby configuring a mobile shelving unit.

It is foreseen that by means of a foot installed in the central housings of each tray, a circular plate may be installed to act as a tray for the placing thereon of products.

It shall be understood that the foregoing detailed description is made for illustrative purposes and that a person skilled in the art may make modifications and variations thereto without straying from the scope of the invention.

What is claimed is:

1. A configurable, dismantlable display case system, with supports for promotional graphics, particularly suited for use as a display cabinet, and with the possibility of changing a promotional campaign thereon as many times as may be necessary, the display case system comprising:

a shelving unit comprising:

(i) trays at different levels, wherein the trays are linked at their corners by pillars of a generally triangular profile with rounded corners, which fit adjustedly into corresponding housings in each tray, wherein blind housings are located one at each corner and on upper and lower sides of each tray;

wherein each tray comprises a flat, horizontal surface of a generally quadrangular shape and with a predetermined thickness, defining a frontal edge, a rearward edge, and lateral edges, and an external wall, perpendicular to the flat surface, and whose medial line is marked by the external line of each horizontal edge of each tray;

wherein each housing at each corner comprises a generally triangular shape with rounded corners, being visible and functional from both above and below the corresponding tray to which the housing is connected;

wherein at the center of an upper part of each tray, four housings are defined for pillars closely facing each other;

wherein each tray further comprises at its corners male-female connecting means to enable the lateral interlocking of corresponding shelving units;

wherein the male-female connecting means are located vertically at the lateral edges of each tray, at one extremity a female connector and at the other extremity a male connector, at the four lateral edges;

(ii) pillars for slotting into the triangular housings of each tray (at the corners or centrally) and comprising perforations located spacedly at their sides;

(iii) short profiles or legs, of a more reduced length than the pillar profiles, of a generally triangular shape with rounded corners which slot adjustedly into corresponding housings of each tray (at the corners or centrally) and also comprise perforations located spacedly at their sides; and (iv) non-slip ferrules inserted into the profile forming the leg.

2. The display case system of claim 1, wherein the short profiles comprise four perforations spacedly located on their sides.

3. The display case system of claim 1, wherein the pillar profiles comprise six perforations spacedly located on their sides.

4. The display case system of claim 2, wherein the pillars comprise a generally triangular profile with rounded corners and are extruded and hollow.

5. The display case system of claim 1, wherein at each of the lateral edges of each tray, engaging grooves are also defined, wherein the engaging grooves extend longitudinally with regard to a vertical plane, and wherein the distances between grooves are less than a width of the tray and less than a distance between male-female connectors.

6. The display case system of claim 5, wherein at the front edge and the rearward edge of the trays, a channel is defined, formed by a pair of vertical grooves and a horizontal groove.

7. The display case system of claim 6, further comprising a flat, smooth board of the same height as the shelving unit, as a supporting format for the lateral promotional graphics, covering the entire height of the shelving unit and fixed by tension between the grooves.

8. The display case system of claim 6, further comprising a flat, smooth board of the same height as the trays, as a supporting format for price ticket strip-type promotional graphics, fixed by slotting into the channel.

9. The display case system of claim 1, wherein the tray comprises on its upper surface two channels or housings for LED (light emitting diode) lighting, located at the front edge and rearward edge of each tray, angled to facilitate the illumination of the products loaded in the shelving unit.

10. The display case system of claim 9, wherein the LED lighting comprising at least one LED lighting strip is installed throughout the length of at least one of the channels and one or more cables of the at least one LED lighting strip are routed through the interior of the shelving unit to the floor, through perforations located in both the tray and the profiles.

11. The display case system of claim 10, wherein the perforations for the one or more cables of the at least one LED lighting strip are located at each extremity of each channel and enable the one or more cables to be routed toward the lower part of the shelving unit for its connection to a power source; in addition, all the housings for the insertion of pillars comprising a perforation at their base, executed for the passage thereby of the one or more cables of the at least one LED lighting strip and their downward routing.

12. The display case system of claim 1, further comprising a rectangularly shaped anti-theft sheet of polycarbonate, cut to the width of each tray and perforated in order to fit together with the perforations of the profiles.

13. The display case system of claim 1, further comprising a diagonalization adaptor, a device comprising a solid item of plastic, with a profile corresponding to the male connector of the tray, designed to be inserted so as to join two female connectors of the tray, thus enabling the joining of several shelving units to form a diagonally staggered line.

14. The display case system of claim 1, further comprising a foot for the installation of castors or of a circular plate acting as a tray; said foot is of a generally triangular profile with rounded corners and comprising an internal threaded hole, and with a height equal to the depth of the housing.

15. The display case system of claim 14, further comprising the circular plate acting as a tray, by means of the foot and a number of studs, is installed in the central housings of each tray, enabling the generation of another surface above the tray for the placement of products to be displayed.

16. The display case system of claim 1, further comprising a connecting device formed by a plate, which follows the outline of the triangular profile with rounded corners, and comprising one part with a flat surface which couples to an elongated rectangular plate, enabling the installation of boards with promotional graphics thereon.

17. A method for the assembly of a configurable, dismantlable display case system, with supports for promotional graphics, and with the possibility of changing a promotional campaign thereon as many times as may be necessary, the method comprising the steps of:

(a) supplying a tray comprised of a flat, generally quadrangular horizontal surface, and with a predetermined thickness defining a frontal edge, a rearward edge and lateral edges, on which the products to be displayed are placed, and an external wall, perpendicular to the flat surface; each tray further comprising at its corners male-female connecting means, enabling lateral interlocking with shelving units; the male-female connecting means being located vertically at the lateral sides of each tray, at one extremity a female connector and at the other extremity a male connector at the four lateral edges; with housings at each corner of a generally triangular shape with rounded corners, both above and below the tray;

(b) supplying pillars, which slot into the triangular housings of the tray, wherein the pillars comprise perforations spacedly located at their sides;

(c) supplying legs or short profiles comprising a more reduced length than the pillar profiles, with a generally triangular shape and with rounded corners, which slot adjustedly into the corresponding housings of the tray and also comprising perforations spacedly located at their sides;

(d) installing non-slip ferrules on the legs;

(e) assembling the legs below a quadrangular tray comprising a flat upper surface and triangular housings with rounded extremities at each corner of its upper and lower faces;

(f) assembling pillars at each corner of the tray; said pillars being formed by profiles generally comprising a triangular cross-section and being hollow, with rounded extremities;

(g) installing another tray on the pillars, with its flat surface facing upwards; and (h) repeating steps (f) and (g) until a shelving unit of the desired height is obtained.

18. The method of claim 17, further comprising the step of:

(i) assembling two shelving units by means joining the male-female connectors defined at the lateral sides of each tray, in such a way that a twin-section shelving unit is formed, be the sections of the same height or of different heights.

19. The method of claim 17, further comprising the step of:

(j) assembling three or more shelving units by joining the male-female connectors defined at the lateral sides of each tray, forming shelving units of three, four or more sections, forming rectangular, square or L-shaped shelving units, each section being of the same height or of different heights, to create larger shelving units, covering a greater area within the sales outlet where they are employed.

20. The method of claim 19, further comprising the step of:

(k) installing feet, to be installed in triangular housings on the underside of a tray; each foot comprising a generally triangular profile with a threaded hole for the installation of castors, thus to configure a mobile shelving unit.

* * * * *